US007410056B2

(12) United States Patent
Cafferata et al.

(10) Patent No.: US 7,410,056 B2
(45) Date of Patent: Aug. 12, 2008

(54) DISPLAY PACKAGE WITH STABILIZING AND INDEXING MEANS

(75) Inventors: Anthony J. Cafferata, Milwaukee, WI (US); Cory J. Nelson, Racine, WI (US); L. Nicholas Senter, Beach Park, IL (US); Stephan M. Stulo, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 299 days.

(21) Appl. No.: 10/699,335

(22) Filed: Oct. 31, 2003

(65) Prior Publication Data

US 2005/0092644 A1 May 5, 2005

(51) Int. Cl.
*B65D 73/00* (2006.01)

(52) U.S. Cl. ..... 206/471; 206/461; 206/764

(58) Field of Classification Search ..... 206/461, 206/471, 705, 764, 776, 806; D9/415
See application file for complete search history.

(56) References Cited

U.S. PATENT DOCUMENTS

| | | | | | |
|---|---|---|---|---|---|
| D273,277 | S | | 4/1984 | Strauss | |
| 4,512,474 | A | | 4/1985 | Harding | |
| 4,531,637 | A | | 7/1985 | Cusmano | |
| 4,669,610 | A | * | 6/1987 | Lindsey et al. | 206/320 |
| 4,749,082 | A | | 6/1988 | Gardiner et al. | |
| 4,781,289 | A | * | 11/1988 | Perkins | 206/45.24 |
| 4,930,627 | A | | 6/1990 | Borst et al. | |
| 5,129,516 | A | | 7/1992 | Theros | |
| 5,429,241 | A | * | 7/1995 | Althaus | 206/471 |
| 5,485,919 | A | | 1/1996 | Samberg et al. | |
| 5,890,594 | A | | 4/1999 | Hansen et al. | |
| 5,947,297 | A | | 9/1999 | Aoki et al. | |
| 5,964,350 | A | | 10/1999 | LaMarche et al. | |
| 6,237,772 | B1 | | 5/2001 | LaMarche et al. | |
| D446,715 | S | * | 8/2001 | Humphrey | D9/415 |
| D447,407 | S | | 9/2001 | Humphrey | |
| D447,408 | S | * | 9/2001 | Humphrey | D9/415 |
| D447,939 | S | | 9/2001 | Humphrey | |
| 6,330,945 | B1 | | 12/2001 | Reimer | |
| D454,490 | S | | 3/2002 | Humphrey | |
| D454,491 | S | | 3/2002 | Humphrey | |
| D455,650 | S | | 4/2002 | Humphrey | |
| D465,413 | S | | 11/2002 | Humphrey | |
| D466,009 | S | | 11/2002 | Humphrey | |
| D467,494 | S | * | 12/2002 | Udwin et al. | D9/415 |
| 6,899,222 | B2 | * | 5/2005 | Jones et al. | 206/305 |
| 2001/0007308 | A1 | * | 7/2001 | Glassman | 206/469 |
| 2002/0189964 | A1 | | 12/2002 | Mazurek | |
| 2003/0150763 | A1 | * | 8/2003 | Chen | 206/471 |

* cited by examiner

*Primary Examiner*—David T Fidei

(57) ABSTRACT

A blister pack and package including such blister pack is described which provides for package stability and self-indexing in relation to adjacently aligned packages. The blister pack is configured to include at least one compartment for enclosing an article, and an outward projecting portion or foot in the bottom portion of the blister pack. The foot is configured to have a width, depth and height sufficient to allow the package to be freestanding and self-indexing. The package is especially suited for use in a merchandise point-of-sale display including a pressure applicator for maintaining displayed packages in a forwardmost position in the display when one or more packages are removed from the display. The foot provides for a predetermined stable spacing during packaging and while in storage and on display, and provides for self-indexing, i.e. maintenance of proper spacing, when a pressure applicator moves the aligned packages forward in a display.

14 Claims, 2 Drawing Sheets

DISPLAY PACKAGE WITH STABILIZING AND INDEXING MEANS

FIELD OF INVENTION

The invention relates to a display package for one or more articles, in particular a blister-type package having means to allow display of the package on a support surface (such as a carrier container or a shelf) as a freestanding package and also to allow for self-indexing when a plurality of the packages are aligned. The packages are especially suitable for use with a pressure applicator used in conjunction with a support surface which moves the packages forward on the support surface as one or more packages are removed from the support surface. The invention also relates to the use of such packaging in merchandise point of purchase or sale display units.

BACKGROUND OF THE INVENTION

Blister-type packages are popular for storing and displaying products for sale. The packages generally include (1) a transparent plastic sheet material preformed into a blister pack which conforms to the shape of a product to be enclosed in the package and (2) a backing, flexible film or display card which is secured to the blister pack and thereby encloses the product. The packages are popular in that they are inexpensive, allow for visual inspection of the product and provide a background surface for imprinting to provide labels which provide product information and an attractive appearance. Blister packages can be hung for display or stacked on a support surface for display, such as a shelf.

Stacking blister packages on support surfaces, however, has certain disadvantages. For example, when a shelf space is completely stocked with product-containing blister packages, the packages are readily visible to and reachable by a consumer. However, as packages are removed from a shelf display, packages become less visible since they are spaced back from the front of the display area. Additionally, when closely stacked, conventional blister packages can be crushed and/or easily topple over resulting in a messy display. Personnel time is then required for restocking and/or reorganizing the display. To overcome this deficiency, many stores now use some means to move the packages forward on the display surface as packages are removed. One manner of providing movement forward is referred to as automated facing and utilizes a spring device or other pressure applying device pressed against the last package in a row of aligned packages which causes the package(s) to move forward into an empty space provided when a package is removed from the display. Due to the pressure applied, however, conventional blister packages tend to be unstable causing them to crush together and/or fall over resulting in a messy display or a display in which it is hard to remove a package or to reinsert a package once removed. Accordingly, a package may not be displayed properly or in good condition resulting in nonconsideration of the product by a consumer and thus a missed sale. With automated facing, therefore, a manufacturer is required to utilize a sturdier, more expensive packaging and/or a retailer must expend increased personnel time to maintain a properly oriented display.

Accordingly, a need exists to provide a blister package which is stable in storage and on display, in particular when used with a pressure applicator which moves packages into a forward visible position when displayed on a support surface. Stability in terms of both the ability to be freestanding and to provide self-indexing upon forced movement would be extremely beneficial.

OBJECTS AND SUMMARY OF THE INVENTION

A primary object of the invention is to provide a blister pack display package including a structural means for stabilizing the package on a support surface.

A further primary object of the invention is to provide a blister pack and a display package including the blister pack having, as part of the blister pack, a foot or outward projecting portion to provide stability to the package in standing and indexing when aligned with other packages.

A further primary object of the invention is to provide a method of displaying blister pack display packages on a support surface in conjunction with a pressure applicator for moving one or more aligned packages while on display, wherein the package is stabilized in terms of being freestanding and self-indexing in relation to other aligned packages.

A blister pack display package of the invention includes a backing or back panel and a blister pack product or article enclosure. The blister pack in combination with a back panel provides for the complete enclosure of an article. The blister pack enclosure includes at least one article compartment and an outward projecting portion or foot in the bottom portion of the pack which serves to stabilize the package for substantially upright display and serves as an indexing means to properly orient the package in a display on a support surface, e.g. a shelf, carrier container or the like. In a point of sale display, stores use a spring device or other pressure applicator to provide constant pressure on aligned packages on display on a shelf or the like to push remaining packages forward as packages are removed from the shelf. The foot of the blister package of the invention has a depth and width sufficient to provide for stability on standing and self-indexing, i.e. predetermined spacing between it and another aligned package. The stability of the package is further enhanced when at least a portion of the depth of an article-containing compartment in the blister pack is the same as the depth of the foot. Preferably, the package structures provides for three points of contact to provide stability and self-indexing, i.e. the front face of the foot, the bottom area of the foot which will contact a support surface and at least a portion of an article compartment having the same depth as the foot.

In a first preferred embodiment, the foot is substantially uniform in width and depth. The width of the foot is preferably substantially the width of the package. The foot also preferably includes in a bottom wall thereof at least two downward protrusions for sitting on a support surface when the package is in an upright position. While the bottom wall does not have to be adjacent the support surface, the closer the point of contact, the more stable the package will be. In an alternative embodiment, one portion of the foot has substantially the same width and depth across the package while another portion has a lesser depth and/or width.

The blister pack is preferably transparent to allow for clear visibility of the one or more articles stored therein. The blister pack is preformed to include one or more areas or compartments conforming at least in part to the shape of the article to be enclosed by the blister pack. The compartment(s) for holding the article(s) can be separate from the outward projecting portion or foot, or the article compartment(s) can be continuous with the foot so that a portion of the article can extend into the internal space of the foot so that the bottom of the article can rest on the inner bottom wall of the outward projecting portion.

The blister packages of the invention are especially suited for display on a support surface in conjunction with a pressure applicator which maintains one or more aligned blister packages of the invention in a forwardmost position in the display so as to maintain visibility and access to the package(s). A method for arranging a plurality of blister packages having a foot as described above for display includes providing an open top carrier container or tray in which a plurality of blister packages are aligned in front to back relationship. The side walls of the container are of a height to hold the packages therein while allowing visibility of the article(s) held in the front blister package. The container having a plurality of packages aligned therein is placed on a support surface having a pressure applicator present in connection therewith so that the pressure applicator abuts the back of an aligned package in the carrier container, so that the pressure applied by the pressure applicator is sufficient to maintain the plurality of packages in abutting front-to-back alignment in a forwardmost position in the carrier container when one of the plurality of packages is removed from the carrier container. The foot of the blister package provides stability to the packages to maintain the packages upright and provide self-indexing between the packages so as to maintain appropriate spacing and alignment. By maintaining proper spacing, crushing of the blister pack is also avoided.

Accordingly, the blister package including the blister pack with foot as described herein provides the advantages of maintaining the packages in an ordered display so that the packages remain upright and forward on a support surface to maintain visibility of and access to the product. Additionally, it is readily determinable when a product requires restocking. The stability feature for spacing and standing allows for a well ordered visible and accessible display and reduces personnel time in maintaining such displays.

DESCRIPTION OF PREFERRED EMBODIMENTS OF THE INVENTION

Figure 1:
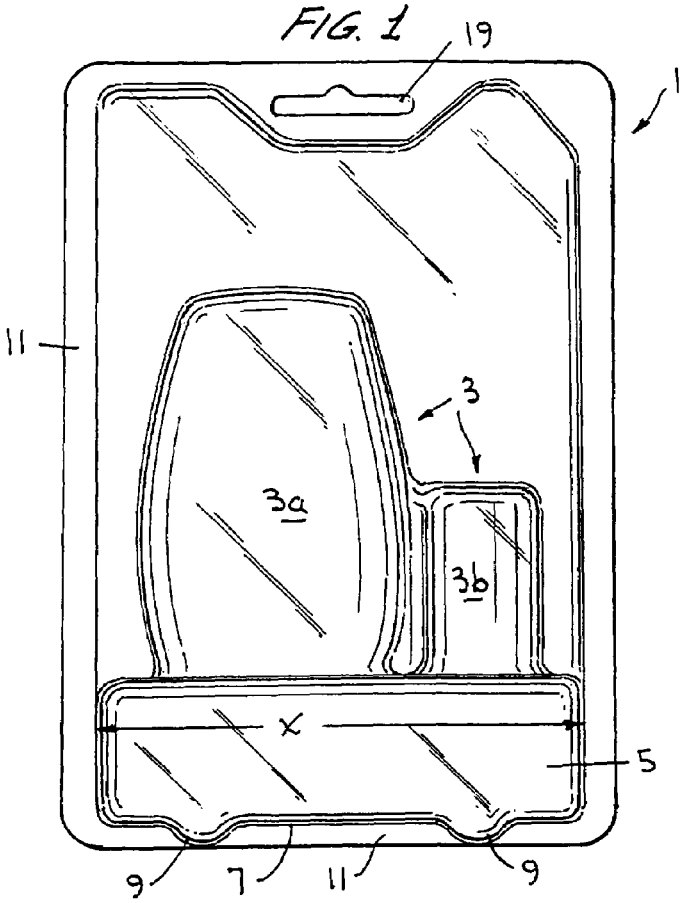
FIG. 1 is a front view of a blister pack according to a first embodiment of the invention.
Figure 2:
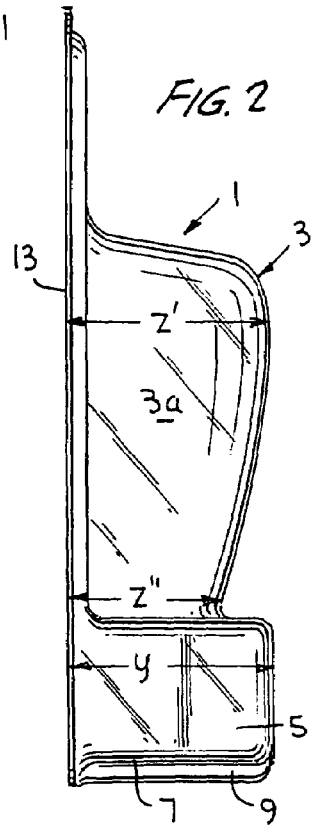
FIG. 2 is a side view of the blister pack of FIG. 1 with a back panel attached thereto.
Figure 3:
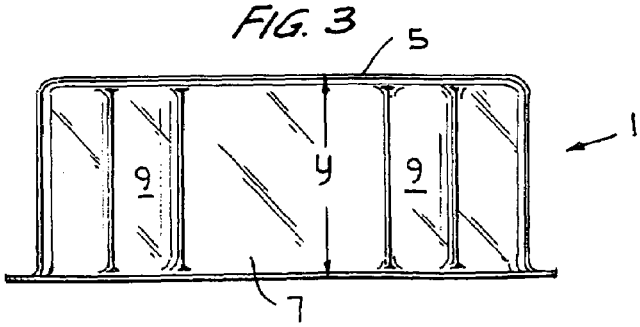
FIG. 3 is a bottom view of the blister pack and back panel of FIG. 2.
Figure 4:
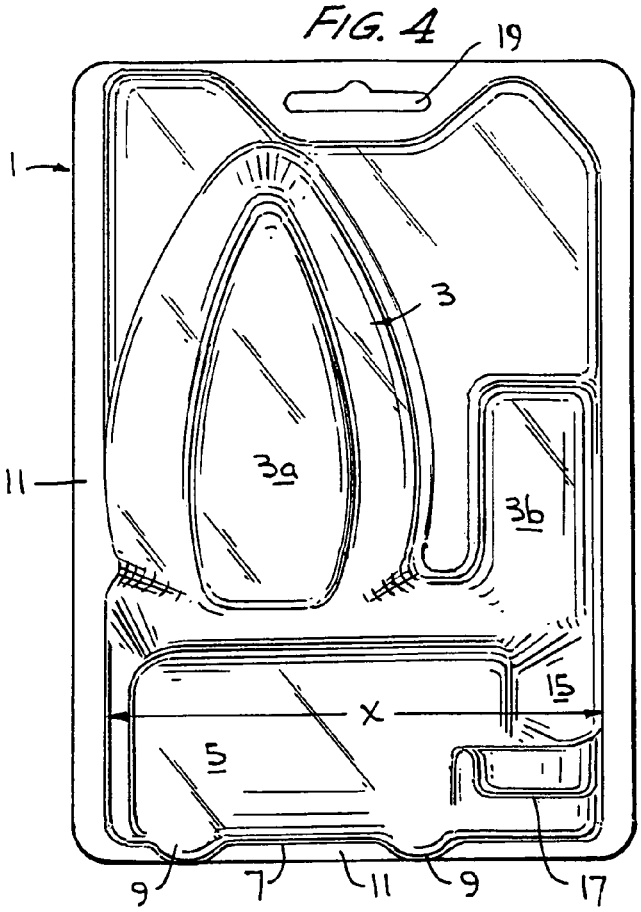
FIG. 4 is a front view of an alternative embodiment of a blister pack according to the invention.
Figure 5:
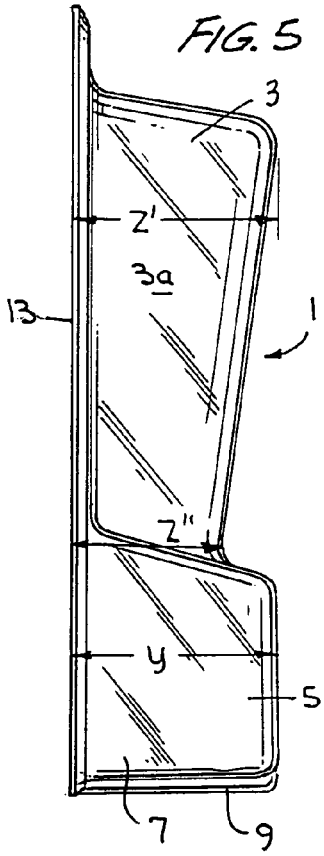
FIG. 5 is a side view of the blister pack of FIG. 4 with a back panel attached thereto.
Figure 6:
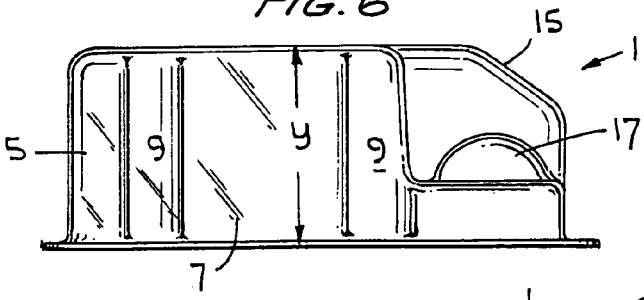
FIG. 6 is a bottom view of the blister pack and back panel of FIG. 5.
Figure 7:
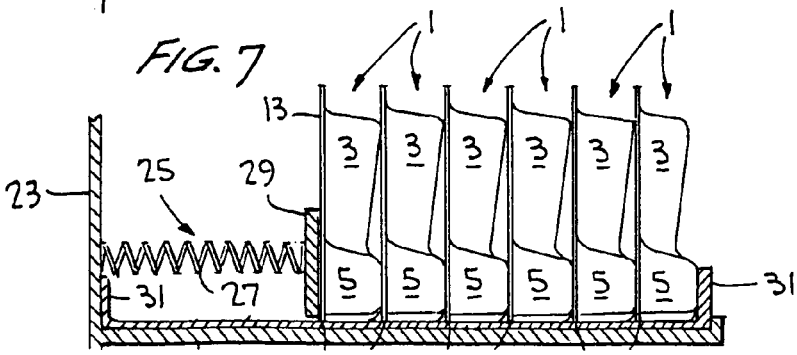
FIG. 7 illustrates a plurality of packages according to the invention aligned in a carrier container positioned on a support surface in conjunction with a spring-operated pressure applicator.

A blister pack and a package including the blister pack and a back panel are shown in the drawings. A first embodiment of the invention is shown in FIG. 1-3 and a second embodiment of the invention is shown in FIGS. 4-6. FIG. 7 illustrates a method of display including the package of the invention.

The blister pack 1 is preformed by conventional thermoform or injection molding, or like method as known in the art for forming a blister pack, from a sheet of plastic. A preferred thermoforming means is a horizontal form fill and seal machine. Alternatively, the blister may be formed on a thermoforming machine and later sealed on a sealing machine. Plastic suitable for use includes polyethylene, polypropylene, polystyrene, polyvinyl chloride, polyvinylacetate, polyamide, polyacrylamide, polymethylacrylate and the like. The forming of the blister pack includes providing at least one compartment 3 which has a shape generally conforming to the article or articles to be held within the blister pack. The compartment(s) in combination with a back panel serve to receive and securely hold for shipping, storage and display one or more article(s). The plastic is preferably transparent to allow for ready viewing of the article(s) by a consumer.

The blister pack of the invention in addition to providing one or more article compartments additionally includes in a bottom portion of the blister pack an outward projecting portion 5 or foot. The foot provides for stability and indexing of the package when used in displaying the article(s) in the packages. The article compartment(s) can be separate from the foot or, as shown in the FIGURES, the article compartment(s) can be continuous with or merge with the foot compartment. As shown in FIGS. 1 and 2, and 4 and 5, the packages illustrated include two article compartments 3*a* and 3*b* wherein the bottom of compartments 3*a* and 3*b* are continuous with foot 5. Thus the bottom portion of an article (not shown) contained in compartments 3*a* and 3*b* will extend into foot 5 using the inside of the bottom wall 7 of foot 5 as a support base for the article.

Foot 5 has a width x and a depth y sufficient to allow the blister package to be freestanding. The width x of at least a portion of foot 5 is preferably substantially the same as the width of the package. The depth y is equal to or greater than the deepest portion of article compartments 3*a* and 3*b*. The width x and depth y are variable depending on the overall size of the package. While the width of foot 5 preferably extends over the substantial width of the package, a lesser width is possible so long as the described function of the foot is achieved. To enhance the stability obtained, the foot may include two or more spaced downward extending protrusions 9 in the bottom wall 7 of foot 5. In the formation of a blister pack, a flange 11 is provided along the outer edge of the pack. Flange 11 provides for a flat space for abutment against a back panel 13, such as a cardboard backing. This point of abutment provides an area for attachment such as by adhesive, heat sealing or the like. The downward extending protrusions 9 can extend across this flange area to allow the base of foot 5 to rest squarely on a support surface and thus maintain the package including the blister pack in a substantially freestanding upright position.

In the first embodiment of FIGS. 1-3, foot 5 is essentially equal in width from side to side, equal in depth from side to side and equal in height from top to bottom except at the downward projecting protrusions 9. The depth y is determined based on the depth of the article compartment(s). In the embodiment of FIGS. 1-3, compartment 3*a* has a greater depth than compartment 3*b*. Within compartment 3*a*, the top portion of the compartment has a greater depth z' than the lower portion which has a depth z". For purposes of providing indexing based on foot 5, as is further described below, the depth y of foot 5, at least over a portion thereof, should be equal to or greater than the greatest depth of the article compartment(s), which in the embodiment of FIGS. 1-3 is depth z' of compartment 3*a*. When the greatest depth of foot 5 is equal to the greatest depth of the article compartment(s), the resulting package has optimum indexing since aligned packages will readily square up against each other in alignment.

In the alternative embodiment shown in FIGS. 4-6, foot 5 below compartment 3*a* has substantially the same configuration as foot 5 in FIG. 1. Below compartment 3*b*, however, foot 5 angles inward at 15 and has a varying height and depth. Bottom wall 7 of foot 5 is the support base for an article contained in compartment 3*a*. Bottom wall 17 is the support base for an article contained in compartment 3*b*. Thus, as long as a portion of foot 5 provides a width x and depth y in a stabilizing amount for freestanding support and indexing (as described herein), foot 5 can provide the advantages of the invention. This allows for variation in sizing of article compartments to provide for better containment and thus protection of an article contained therein.

The illustrated blister pack in use contains an article in compartments 3*a* and 3*b*. A back panel 13 is attached to blister pack 1 along flange 11. Foot 5 provides for a desired spacing between a plurality of the packages when the packages are placed in front to back alignment, such as in a sales display. The blister pack provides self-indexing when packages are hung using a rod through an opening 19 or packages are stood on a support surface, such as a shelf.

The advantage in a hanging display is that foot 5 provides for spacing in order that an appropriate number of the packages can be neatly positioned and avoid overcrowding and crushing of the packages. An organized display of undamaged packages is then provided.

In relation to a support surface, the foot allows the package to be freestanding, provides for automatic spacing, and self-indexing, during placement of the packages in a carrier container, during storage and shipping, and upon display. A package including a blister pack 1 with foot 5 is especially advantageous for self-indexing when positioned on a support surface having in conjunction therewith a pressure applicator. Many stores utilize a pressure applicator arranged in the back of a shelf display to push packages forward as packages are removed from the display. This serves to maintain the displayed packages in a forwardmost position on the shelf for good visibility to and access by a consumer. An example of such arrangement with the packages of the invention is shown in FIG. 7.

A shelf 21 has a back wall 23. Attached to back wall 23 is a pressure applicator 25, which may be a spring 27 with a push panel 29. A plurality of packages are positioned in a front to back alignment in an open top carrier container 31. Push panel 29 abuts the back panel 13 of the last package present in container 31. As a forward positioned package 1 is removed from container 31, the remaining packages present are moved forward by pressure applicator 25 to fill the resulting empty space. A package is thus always forwardmost on the shelf for visibility and access. This arrangement also allows for store personnel to readily determine when a display is empty and restocking is required. Additionally, the display remains neat and organized reducing the time for a shopper to find the product and reducing the time required by store personnel to reorganize a display which occurs when packages would fall over or are tipped over in a display or are positioned at the back of a shelf following removal of the forwardmost packages.

Accordingly, the blister pack of the invention with foot 5 provides numerous advantages for the manufacturer, the point-of-sale seller and the consumer.

As will be apparent to one skilled in the art, various modifications can be made within the scope of the aforesaid description. Such modifications being within the ability of one skilled in the part form a part of the present invention and are embraced by the appended claims.

The invention claimed is:

1. A package for containing and displaying at least one article comprising a back panel, and a front panel attached to said back panel, wherein said front panel comprises a blister pack formed of plastic and including a first outward projecting portion in a bottom portion of said blister pack and at least one additional outward projecting portion having a depth and shape conforming to at least a portion of said at least one article, wherein at least a portion of said first outward projecting portion extends widthwise at least a substantial portion between a first side of said blister pack and a second side of said blister pack, and has a depth outward sufficient to allow said package to stand substantially upright, wherein said depth of said at least a portion of said first outward projecting portion is equal to a greatest depth of an outermost projecting portion of said at least one additional outward projecting portion so that said package is self-indexing when said package is aligned with one or more packages having a structure of said package; and wherein said first outward projecting portion includes a bottom wall having integral therein at least two spaced apart downward protrusions.

2. A blister pack for a display package for at least one article, said blister pack comprising a plastic body including a first outward projecting portion in a bottom portion of said body, with at least a portion of said first outward projecting portion extending widthwise at least a substantial portion between a first side of said body and a second side of said body, and said at least a portion of said outward projecting portion having a depth outward sufficient to allow said body to stand substantially upright, and said body further including at least one additional outward projecting portion having a depth and shape conforming to at least a portion of said at least one article, wherein said depth of said at least a portion of said first outward projecting portion is equal to a greatest depth of an outermost projecting portion of said at least one additional outward projecting portion so that said blister pack is self-indexing when said blister pack is aligned with one or more blister packs having a structure of said blister pack; and wherein said first outward projecting portion includes a bottom wall having integral therein at least two spaced apart downward protrusions.

3. A package according to claim 1 wherein said at least one additional outward projecting portion is continuous with said first outward projecting portion.

4. A blister pack according to claim 2 wherein said at least one additional outward projecting portion is continuous with said first outward projecting portion.

5. A package according to claim 1 wherein said first outward projecting portion includes a front wall of uniform depth or non-uniform depth.

6. A blister pack according to claim 2 wherein said first outward projecting portion includes a front wall of uniform depth or non-uniform depth.

7. A package according to claim 5 wherein one of said portions of non-uniform depth is a wall of one of said at least one additional outward projecting portion.

8. A blister pack according to claim 6 wherein one of said portions of non-uniform depth is a wall of one of said at least one additional outward projecting portion.

9. A package according to claim 1 wherein said first outward projecting portion is substantially rectangular.

10. A blister pack according to claim 2 wherein said first outward projecting portion is substantially rectangular.

11. A package for containing and displaying at least one article comprising a back panel, and a front panel attached to said back panel, wherein said front panel comprises a blister pack formed of plastic and including a first outward projecting portion in a bottom portion of said blister pack and at least one additional outward projecting portion having a depth and shape conforming to at least a portion of said at least one article, wherein at least a portion of said first outward projecting portion extends widthwise at least a substantial portion between a first side of said blister pack and a second side of said blister pack, and has a depth outward sufficient to allow said package to stand substantially upright, and wherein a portion of said at least one additional outward projecting portion is equal in depth to a greatest depth in the first outward projecting portion and is at a position in said package to render said package self-indexing when said package is aligned with one or more packages having a structure of said package, and a portion of said depth of said at least one additional outward projecting portion is of lesser depth than the greatest depth in the first outward projecting portion; and wherein said first outward projecting portion includes a bottom wall having integral therein at least two spaced apart downward protrusions.

12. A blister pack for a display package for at least one article, said blister pack comprising a plastic body including a first outward projecting portion in a bottom portion of said body, with at least a portion of said first outward projecting portion extending widthwise at least a substantial portion between a first side of said body and a second side of said body, and said at least a portion of said outward projecting portion having a depth outward sufficient to allow said body to stand substantially upright, and said body further including at least one additional outward projecting portion having a depth and shape conforming to at least a portion of said at least one article, wherein a portion of said at least one additional outward projecting portion is equal in depth to a greatest depth in the first outward projecting portion and is at a position in said blister pack to render said blister pack self-indexing when said blister back is aligned with one or more blister packs having a structure of said blister pack, and a portion of said depth of said at least one additional outward projecting portion is of lesser depth than the greatest depth in the first outward projecting portion; and wherein said first outward projecting portion includes a bottom wall having integral therein at least two spaced apart downward protrusions.

13. A package according to claim 1 wherein two of said at least one additional outward projecting portions are present wherein said two of said at least two additional outward projecting portions are of different depths from each other.

14. A blister pack according to claim 2 wherein two of said at least one additional outward projecting portions are present wherein said two of said at least two additional outward projecting portions are of different depths from each other.

* * * * *